United States Patent [19]

Donoso

[11] 4,392,755

[45] Jul. 12, 1983

[54] MAGNETIC DOT MATRIX PRINTING

[75] Inventor: Patricio E. Donoso, Streamwood, Ill.

[73] Assignee: Extel Corporation, Northbrook, Ill.

[21] Appl. No.: 347,649

[22] Filed: Feb. 10, 1982

[51] Int. Cl.[3] ..... B41J 3/12; B41J 27/16; B41J 3/16

[52] U.S. Cl. ..... 400/119; 101/DIG. 5; 101/426; 346/74.2

[58] Field of Search ..... 400/118, 119; 101/DIG. 5, 93.04, 426; 346/74.2, 74.5; 430/39

[56] References Cited

U.S. PATENT DOCUMENTS

| | | | |
|---|---|---|---|
| 2,841,461 | 7/1958 | Gleason | 346/74.5 X |
| 2,985,135 | 5/1961 | Hickerson | 400/119 |
| 3,142,840 | 7/1964 | Smith et al. | 346/74.5 |
| 3,254,626 | 6/1966 | Uemura | 346/74.5 X |
| 3,593,832 | 7/1971 | Damouth et al. | 400/119 |
| 3,683,382 | 8/1972 | Ballinger | 101/DIG. 5 |
| 3,684,075 | 8/1972 | Staller et al. | 400/119 |
| 3,735,416 | 5/1973 | Ott et al. | 346/74.2 |
| 3,825,936 | 7/1974 | Ott et al. | 346/74.2 |
| 3,890,623 | 6/1975 | Schmid et al. | 346/74.5 |
| 4,072,957 | 2/1978 | Kokaji et al. | 346/74.2 |

FOREIGN PATENT DOCUMENTS 23452 2/1981 European Pat. Off. ..... 101/DIG. 5

*Primary Examiner*—Paul T. Sewell

*Attorney, Agent, or Firm*—Kinzer, Plyer, Dorn & McEachran

[57] ABSTRACT

In a method and apparatus for magnetic printing on plain paper, using a dot matrix format, a sheet of paper is positioned on the surface of a thin, elongated strip platen of permanent magnet material and a magnetic printhead scans the platen, magnetizing dot size portions of the platen in dot matrix patterns defining magnetic images of the data characters in a line of text; limited quantities of toner are applied to the paper to develop those images as visible characters on the paper. After development, the platen is displaced transversely of the paper surface to an inactive position, permitting movement of the paper, without disturbance of the developed images, to bring the line of developed character images to a separate fixing station at which fixing is effected without incurring the possibility of damage to the platen.

22 Claims, 10 Drawing Figures

Fig. 4.
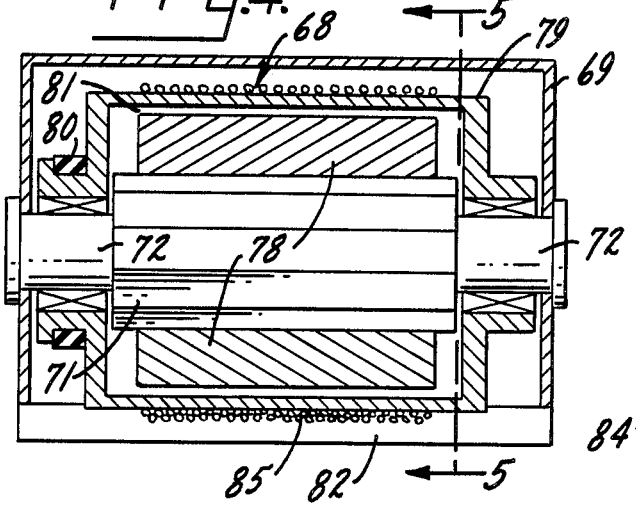
Fig. 5.
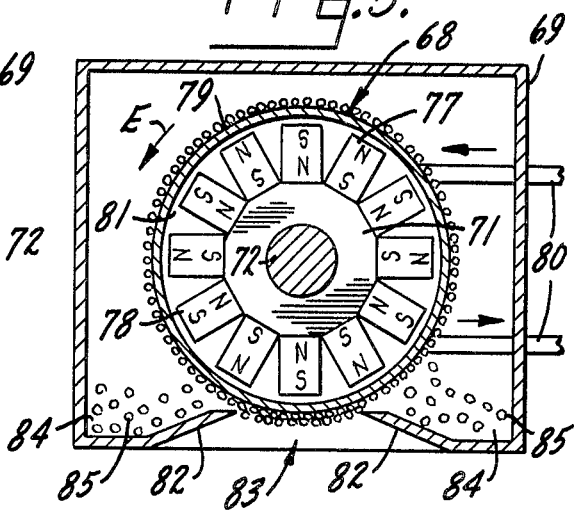
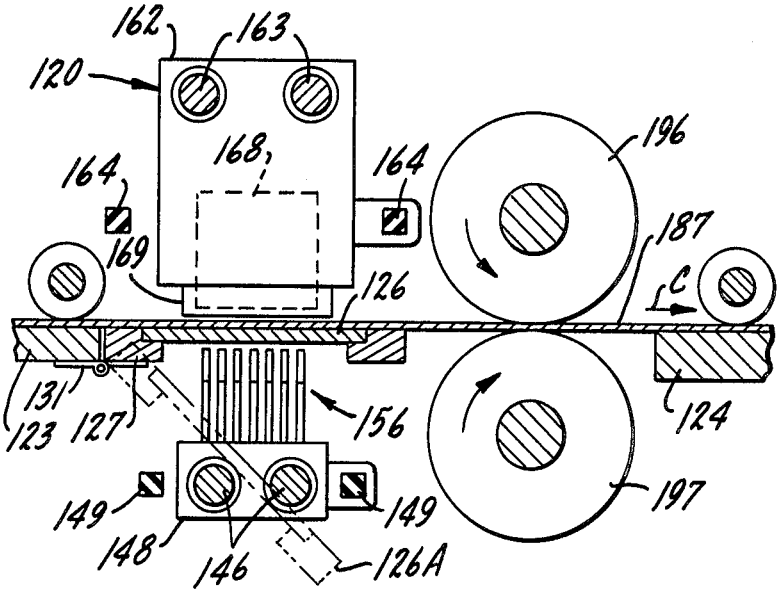
Fig. 7.
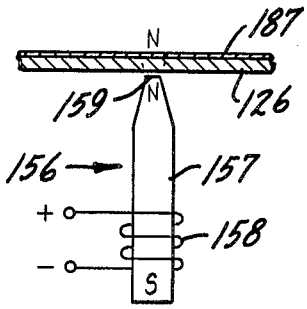
Fig. 8.
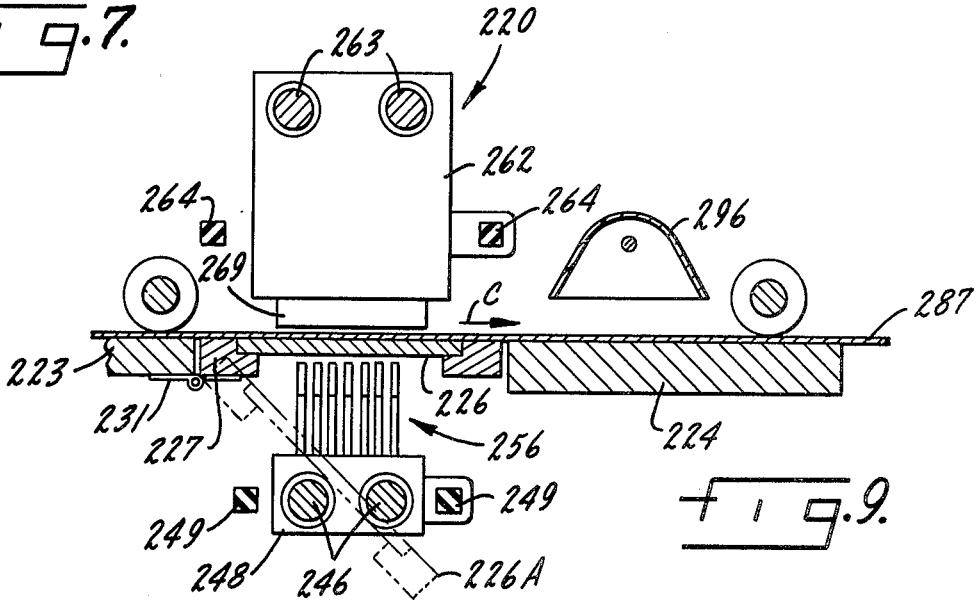
Fig. 9.

MAGNETIC DOT MATRIX PRINTING

CROSS REFERENCE TO RELATED APPLICATION

This invention comprises an improvement of a method and apparatus for magnetic dot matrix printing described in the co-pending application of Robert Adler, Ser. No. 347,716, filed concurrently herewith, entitled "Magnetic Dot Matrix Printing Method and Apparatus."

BACKGROUND OF THE INVENTION

In many printer applications, including virtually all general office applications, character-by-character reproduction on plain paper is a basic requirement; availability of the last character printed for operator inspection (last character visibility or "LCV") is always highly desirable and sometimes essential. These applications include communication printers (telex and the like), word processors, and even ordinary typewriters.

Despite an undesirably high noise level, impact printers of various kinds, including column-sequential dot matrix printers, printers having individual character keys such as conventional typewriters, and unitary font impact printers, such as "golf ball" and "daisy wheel" printers, predominate. The dominance of the impact printers results from their general capability of reproduction on plain paper on the requisite character-by-character basis, ready adaptability to provision of last character visibility, and basic economy and reliability in construction and operation.

The noise problem inherent in impact printers of all kinds is effectively eliminated in electrostatic printers and in electromagnetic printers, which have been successful in some high speed and high volume printing applications. These devices, however, have not proved competitive in general office applications requiring machines of minimal complexity and subject to only moderate requirements as regards output volume. On the one hand, electrostatic and electromagnetic printing techniques are difficult to adapt to character-by-character data reproduction, and are even more difficult to apply to a printer affording LCV capability. On the other hand, when adapted to individual character reproduction the cost and complexity of reliable electrostatic or electromagnetic printing mechanisms capable of printing on plain paper tend to be excessive as compared with impact printers.

A system of magnetic character-by-character printing on plain paper, suitable for general office applications, that allows for effective last character visibility, using mechanisms that are inexpensive yet quiet and reliable, is described in the aformentioned co-pending application of Robert Adler. In that magnetic printing system, a sheet of plain paper is positioned on a thin strip platen of permanent magnet material and the platen is scanned with a recording head comprising a group electromagnets that are selectively energized to magnetize incremental dot size portions of the platen, forming magnetic images of a line of characters in the platen. The magnetic images are developed by application of a magnetic toner and the resulting visible data character images are then fixed to the paper by heat or pressure, after which the magnetic images are erased from the platen and the process is repeated for the next line of text.

Pressure fixing of the printed characters while still positioned over the platen, in the Adler system, presents some potential problems because the platen is quite thin and may be relatively fragile, so that it is poorly suited to withstand the appreciable pressures involved. Heat fusion fixing, using a radiant heat source that moves conjointly with the recording head, can be employed to minimize or avoid this problem, but this expedient introduces another problem; it is difficult to provide a heat source of adequate intensity that is small enough. If a conventional line feed advance or like shifting movement of the paper is used to move the paper away from the platen prior to fixing of the developed images, the characters are smeared into illegibility by the attraction of the magnetic images in the platen. Moreover, the magnetic images cannot be erased prior to fixing, while the developed printed characters remain over te platen; erasing destroys the unfixed print.

SUMMARY OF THE INVENTION

It is a principal object of the present invention, therefore, to provide a new and improved method and apparatus for electromagnetic printing on plain paper, suitable for general office applications, that effectively allows for displacement of the paper to bring developed character images to a fixing station displaced from a magnetic platen without smearing or otherwise damaging those characters.

Another object of the invention is to provide a new and improved method and apparatus for electromagnetic printing on a character-by-character basis on plain paper that permits use of separate printing and fixing stations yet allows for effective last character visibility.

A further object of the invention is to provide a new and improved electromagnetic printer, affording character-by-character printing on plain paper, using separate character-forming and fixing stations, that is simple and economical in construction and reliable and quiet in operation.

Accordingly, in one aspect the invention relates to a method of magnetic dot matrix printing, for printing a character text on a sheet of non-magnetic paper, comprising the following steps in sequence:

A. positioning a sheet of non-magnetic paper on a platen of permanent magnet material with the platen in a predetermined print position;

B. magnetizing dot size portions of the platen in accordance with predetermined patterns constituting magnetic images of the characters for a line of text; and C. developing visible images of the characters on the paper by applying limited quantities of a magnetic toner to the exposed surface of the paper overlying the platen.

The improved method of the invention comprises the following additional steps:

D. displacing the platen from its print position, away from the paper, in a direction generally transverse to the surface of the paper, through a distance sufficient to preclude substantial magnetic attraction between the magnetic images and the toner comprising the developed visible images;

E. advancing the paper, in a direction substantially parallel to the paper surface, to move the visible toner images to a fixing position clear of the printing position of the platen after step D; and F. fixing the visible toner images on the paper at the fixing position.

In another aspect, the invention is directed to a magnetic dot matrix printer for printing a character text on a sheet of non-magnetic paper, of the kind comprising an elongated strip platen of permanent magnet material, and means for positioning a sheet of non-magnetic paper on one surface of the platen with the platen extending across the paper in alignment with a portion of the paper comprising a location for a line of text. Magnetic recording means, comprising a plurality of electromagnets having magnetizing poles corresponding to a group of character matrix dots, are provided for magnetizing dot size portions of the platen in accordance with predetermined patterns constituting magnetic images of the characters for a line of text by selective energization of the electromagnets; magnetic toner dispensing means apply limited quantities of a magnetic toner to the exposed surface of the paper overlying the platen to develop visible images, corresponding to the magnetic images, on the paper, and magnetic erasing means are provided for erasing the magnetic images from the platen in preparation for printing a further line of text. The improved printer of the present invention further comprises platen displacement means for displacing the platen, in a direction generally transverse to the paper surface, between a print position engaging the paper and an inactive position, the displacement between the two platen positions being sufficient to preclude substantial magnetic attraction between the magnetic images and the visible toner images when the platen is in its inactive position; line feed means are provided for advancing the paper, in a direction substantially parallel to the paper surface, to move the visible toner images to a fixing position displaced from the platen print position, and fixing means fix the visible toner images on the paper, while at the fixing position, to complete printing of a line of text on the paper.

BRIEF DESCRIPTION OF THE DRAWINGS

FIG. 4 is a detail sectional view, on an enlarged scale, of a toner dispensing device incorporated in the printer mechanism of FIG. 1, taken approximately as indicated by line 4—4 in FIG. 1;

FIG. 5 is a detail sectional view taken approximately as indicated by line 5—5 in FIG. 4;

FIG. 7 is a partially schematic detail sectional elevation view, similar to FIG. 2, of another embodiment of a magnetic dot matrix printer constructed in accordance with the present invention and effective for carrying out the method of the invention;

FIG. 8 is a detail view, on an enlarged scale, used to explain operation of the recording head in the printer of FIG. 7; and FIG. 9 is a schematic sectional detail elevation view, similar to FIG. 7, illustrating another embodiment of the invention.

DESCRIPTION OF THE PREFERRED EMBODIMENTS

Figure 1:
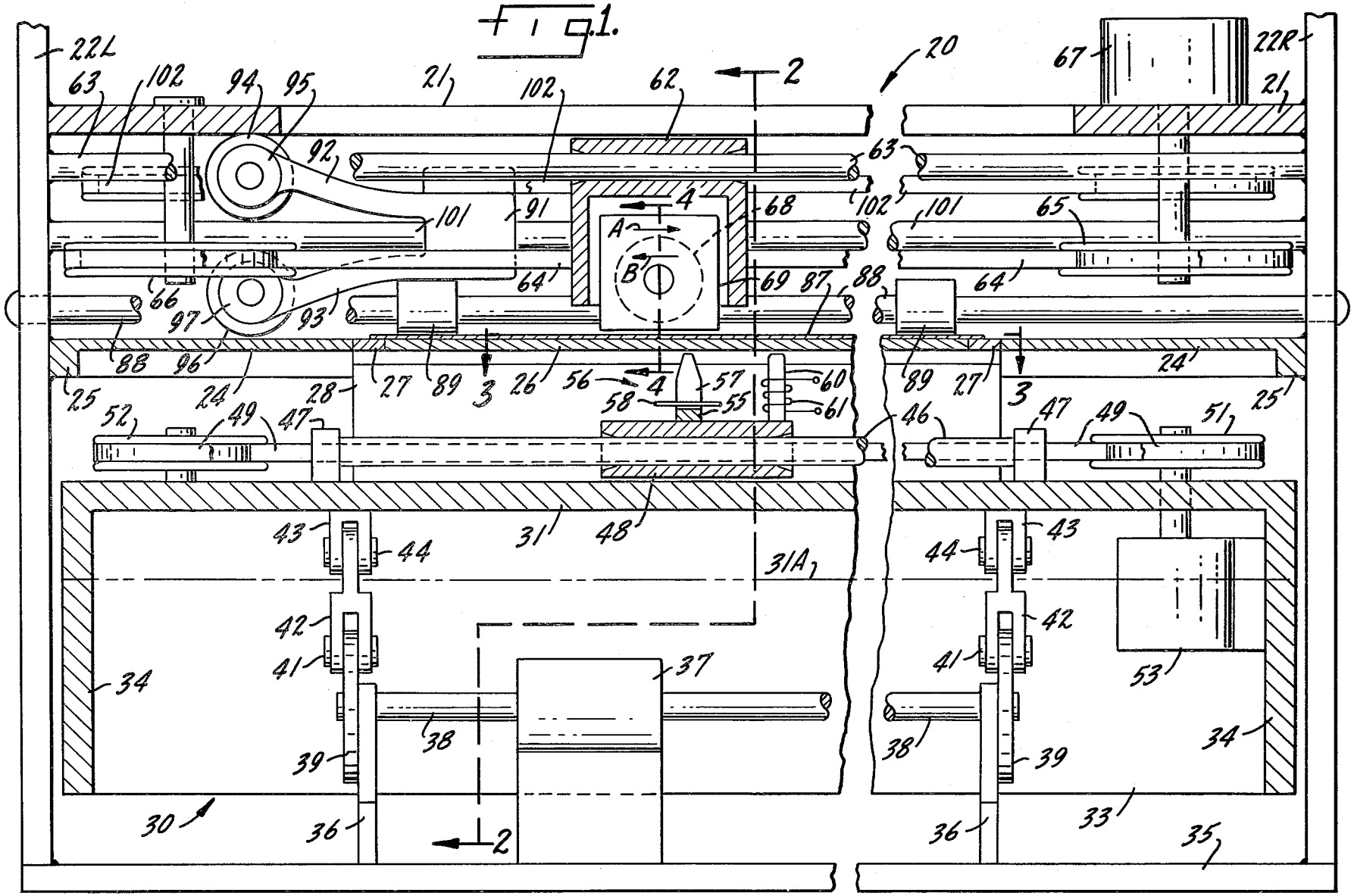
FIG. 1 is a partially sectional and partially schematic elevation view of a magnetic dot matrix printer constructed in accordance with one embodiment of the present invention and capable of performing the printing method of the invention.
Figure 2:
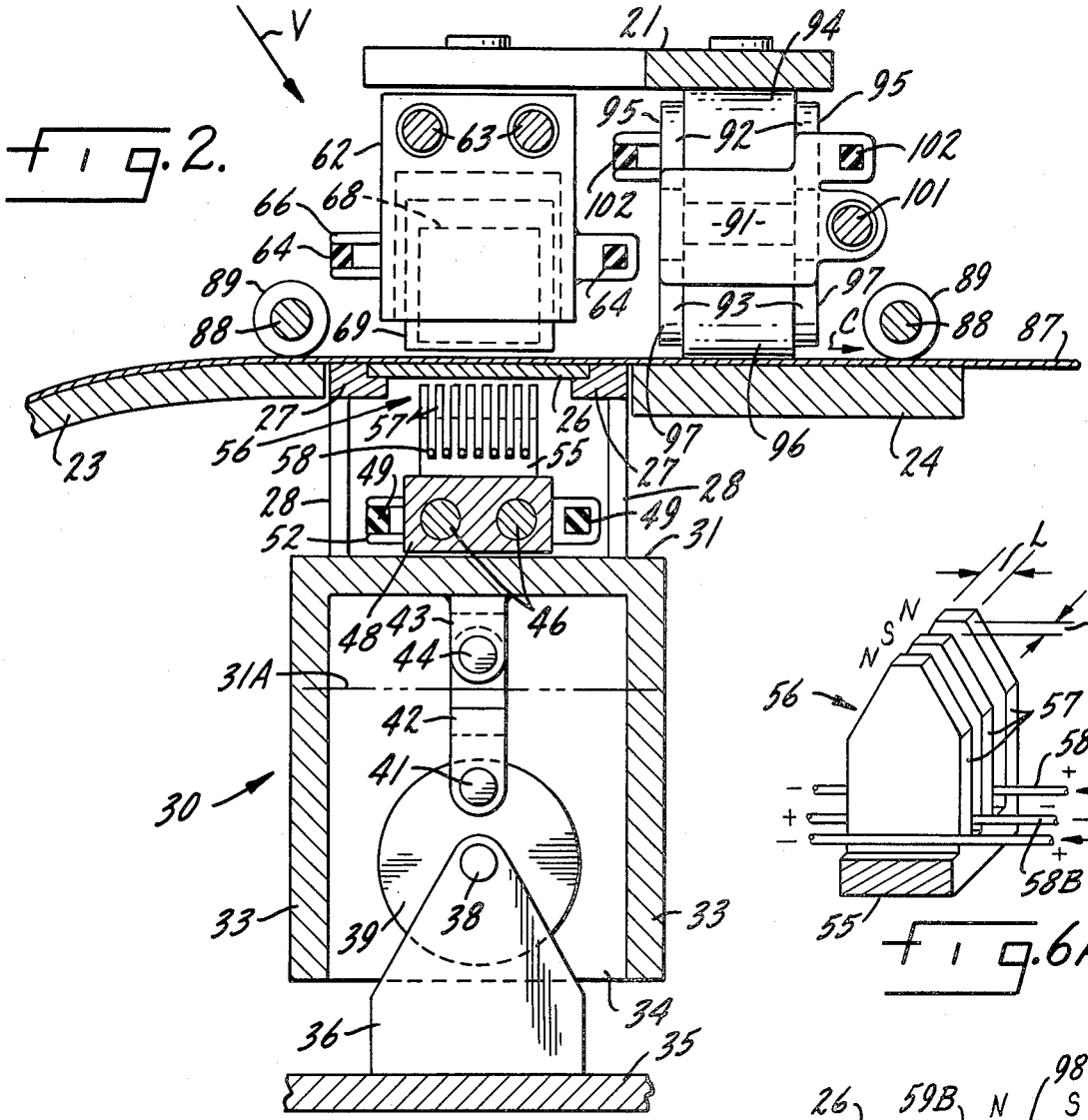
FIG. 2 is a sectional elevation view taken approximately as indicated by line 2—2 in FIG. 1.
Figure 3:
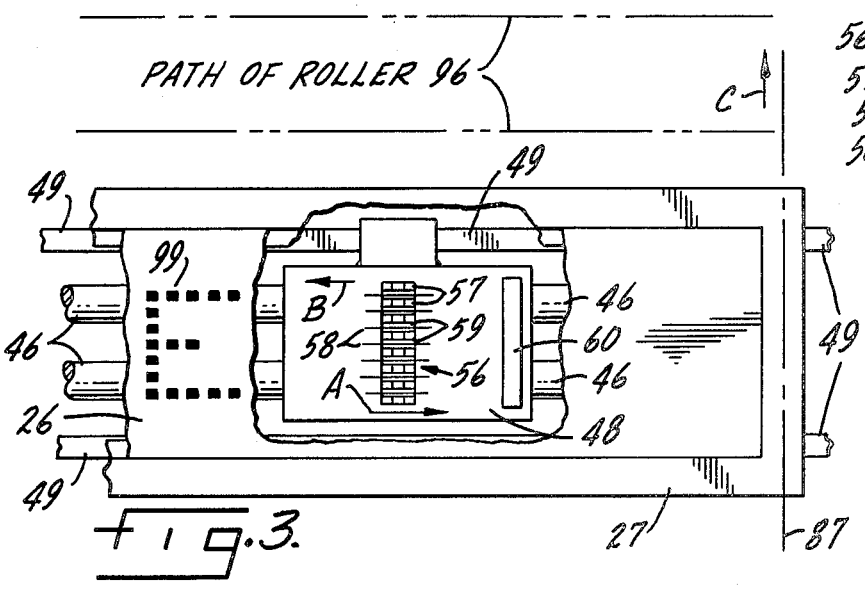
FIG. 3 is a detail sectional plan view taken approximately as indicated by line 3—3 in FIG. 1.

FIGS. 1-3 illustrate a magnetic dot matrix printer 20 constructed in accordance with one embodiment of the present invention and capable of carrying out a method of dot matrix printing pursuant to the invention. In FIGS. 1-3, only those portions of the printer specifically involved in the present invention are illustrated; familiarity with conventional printer apparatus, including line feed paper drive mechanisms and operating circuits, printhead carriage drive circuits, dot matrix print element energizing circuits, and like conventional components is assumed.

As shown in FIGS. 1 and 2, printer 20 comprises an upper fixed frame member 21 that extends across printer between two side frame members 22L and 22R. A pair of fixed paper supports 23 and 24 also extend across printer 20, between side frame members 22L and 22R, at a location spaced from frame member 21. Paper supports 23 and 24 may be formed as integral parts of a single support member, being joined by one or more end members 25 (see FIG. 1).

A thin, elongated strip platen 26 (FIGS. 1-3) extends transversely of printer 20 at a location intermediate the two paper supports 23 and 24; see FIG. 2. In this embodiment of the invention the platen is formed of an erasable permanent magnet material having high remanence and moderate coercive force. Two specific permanent magnet materials that can be used for the platen in printer 20 are a copper-nickle-iron alloy known by the trade name "Cunife" and a chromium-nickel-iron alloy designated as "Chromindur." For these materials, the magnetic characteristics are approximately as follows:

| Cunife | Chromindur |
|---|---|
| $H_c$ = 550 oersteds | $H_c$ = 500 oersteds |
| $B_r$ = 5,400 gauss | $B_r$ = 10,000 gauss |

The thickness of platen 26 is preferably of the order of approximately 0.1 to 0.25 millimeters, for reasons that will be made apparent in connection with the operational description set forth below.

Platen 26 is mounted within a rectangular frame 27 that is in turn supported upon a pair of vertical platen supports 28 that extend across printer 20 as illustrated in FIGS. 1 and 2. Platen supports 28 are part of an elevator mechanism 30 which includes an elongated rectangular elevator platform 31 having depending side walls 33 and end walls 34.

Elevator 30 is mounted on a fixed base 35. The support arrangement for platform 31 comprises two stanchions 36 that are affixed to base 35. A motor 37 is mounted between the two stanchions, with the shaft 38 of the motor being journalled in suitable bearings (not shown) in both stanchions. At each stanchion 36, a disc 39 is affixed to the motor shaft and each disc 39 has a pin 41 mounted at an eccentric location on the disc. Each pin 41 serves as a pivot pin for one end of a bifurcated lever 42, the other end of lever 42 in each instance being pivotally connected to a clevis 43 by a pin 44. The two clevises 43 are mounted on the bottom of elevator platform 31.

A pair of guide rails 46 extend longitudinally across the top of elevator platform 31, supported by two mounting blocks 47 affixed to the top of the elevator platform. A first carriage 48 is slidably mounted upon guide rails 46. A drive belt 49 is connected to carriage 48. Belt 49 extends around a drive pulley 51 and an idler pulley 52 mounted at opposite ends of elevator platform 31 (FIG. 1). A drive motor 53 for pulley 51 is mounted below the platform.

A magnetic recording head 56 is mounted on carriage 48. The magnetic recording head comprises a plurality of electromagnets formed by a series of vertical magnetic cores 57 projecting upwardly from a common magnetic base 55 and a series of electrical conductors 58 extending through the core structure between the individual cores (FIGS. 1 and 3). Each electromagnet includes two of the cores 57 and the intervening conductor 58, thus affording two magnetizing poles separated by a small air gap. The interior cores 57 each constitute part of two of the electromagnets, as explained hereinafter in connection with FIGS. 6A and 6B.

As best shown in FIG. 3, the pole gaps 59 between the electromagnet cores 57 are arranged in a columnar array; the illustrated arrangement includes eight cores 57 and seven conductors 58 so that there are seven electromagnets in recording head 56, suitable for printing in the familiar seven-by-five dot matrix pattern frequently employed in various types of dot matrix printers. However, it should be understood that the number of electromagnets in recording head 56 is a matter of design choice; a larger or smaller number of electromagnets may be utilized. Furthermore, the electromagnets of the recording head may be arranged in two staggered columns or in other appropriate patterns, so long as the arrangement selected is suitable for printing alphabetic, numeric, and other data characters.

An erasing electromagnet comprising a core 60 and a coil 61 is also mounted on carriage 48 (FIG. 1). As best shown in FIG. 3, the core 60 of the erasing electromagnet extends across the major portion of platen 26, at least for the full length of the array of electromagnets in recording head 56.

Printer 20 further comprises a second carriage 62 that is slidably mounted on two guide rails 63 affixed to and extending between the printer side frame members 22L and 22R. A drive belt 64 is connected to carriage 62 and engages a drive pulley 65 and an idler pulley 66 mounted on opposite ends of the upper frame member 21. A drive motor 67 is provided for pulley 65; motor 67 is mounted on frame member 21. The two carriage drive motors 53 and 67 should be driven synchronously, so that carriages 48 and 62 are maintained in the same relative positions during normal printing operations. One motor operatively connected to both carriages can be used if preferred. The two carriages are sometimes referred to conjointly hereinafter as "carriage means."

A dispenser for magnetic toner is incorporated in printer 20, being illustrated as a magnetic brush 68 (FIG. 1). The magnetic brush 68 is mounted in a housing 69 which is in turn mounted upon the upper carriage 62.

The construction and operation of the toner dispenser comprising magnetic brush 68 can best be understood with reference to FIGS. 4 and 5. As shown therein, magnetic brush 68 comprises a stationary central shaft 71 having end portions 72 of reduced diameter mounted in housing 69. A plurality of radially magnetized segmental permanent magnets 77 and 78 are affixed to shaft 71 in alternation with each other. The permanent magnets 77 are magnetized to have north outer poles and the magnets 78 are magnetized with their south poles outermost. A unitary, radially magnetized annular permanent magnet can be substituted for this segmental magnet structure.

A cylindrical non-magnetic shell 79 is rotatably mounted within housing 69 in encompassing relation to the annular array of magnets 77 and 78. Shell 69 is continuously rotated by suitable means, such as a drive belt 80 and a small electrical motor (not shown). A small annular air gap 81 separates shell 79 from the outer pole faces of the permanent magnets 77 and 78.

The bottom wall of housing 69 (FIGS. 4 and 5) comprises two upwardly inclined segments 82 separated by a relatively wide opening 83. Thus, an appreciable portion of the bottom of the shell 79 is exposed through opening 83. The bottom wall segments 82 also form two shallow pockets 84 for storing a limited quantity of magnetic toner particles 85.

Magnetic brush 68, as illustrated in FIGS. 4 and 5, is generally conventional; a magnetic brush of this general type is described in Berkowitz U.S. Pat. No. 3,945,343. Accordingly, only a brief description of its basic mode of operation is necessary. In use, shell 79 is rotated continuously, revolving around the ring of permanent magnets 77 and 78 in the direction indicated by arrows E. The toner particles 85 are magnetically attracted toward the surface of shell 79 by magnets 77, 78 and migrate around the periphery of the shell in the direction of rotation, arrow E. This brings the toner particles 85 on the surface of shell 79 to the opening 83 in the bottom wall of housing 69. These toner particles are thus available for attraction, in a downward direction from magnetic brush 68, in response to any magnetic pole at a location below the brush.

Printer 20 (FIGS. 1–3) includes suitable means for positioning a sheet 87 of non-magnetic paper on platen 26 in surface-to-surface contact with the platen. Because paper feed mechanisms are well known in the art, only a minimum portion of this part of the printer is shown in the drawings, comprising a pair of paper bails 88 with rollers 89 that engage the paper sheet 87 near its edges. However, it should be understood that the complete printer includes an appropriate paper feed mechanism for advancing the paper sheet 87 across platen 26 in line-width increments in the direction indicated by arrows C in FIGS. 2 and 3.

Printer 20 further includes a third carriage 91, sometimes called a fixing carriage, comprising two pairs of spring arms 92 and 93. A roller 94 is mounted between the outer ends of the upper pair of spring arms 92 by means of two anti-friction bearings 95. Roller 94 engages the bottom surface of the upper fixed frame member 21. Similarly, a pressure fixing roller 96 is mounted between the free ends of the lower pair of spring arms 93 by means of two anti-friction bearings 97. The pressure fixing roller 96 engages the upper surface of paper support 24. Carriage 91 is guided by a guide rail 101 and moved by a drive belt 102 (FIGS. 1 and 2).

In utilizing printer 20 to carry out the method of the present invention, a sheet of ordinary paper 87 is positioned in surface-to-surface contact with the erasable permanent magnet platen 26 as shown in FIGS. 1 and 2; the location of the right-hand edge of the paper sheet 87 is indicated in FIG. 3. The paper sheet is held in firm engagement with the platen by the roller 89 on bails 88. The platen extends across the paper in alignment with a portion of the paper comprising a location for printing a line of text on the paper.

To print a line of text on paper 87, carriages 48 and 62 are first driven conjointly, by motors 53 and 67, along a print path extending longitudinally of platen 26, from the left-hand side to the right-hand side of the paper, as viewed in FIGS. 1 and 3, in the direction of arrows A. This causes the magnetic recording head 56 to scan the lower surface of platen 26, traversing the desired text line location. During this scanning movement, in the direction of arrow A, the operating coils 58 of the electromagnets comprising recording head 56 are selectively energized for brief intervals to magnetize dot size portions of platen 26.

Figure 6A:
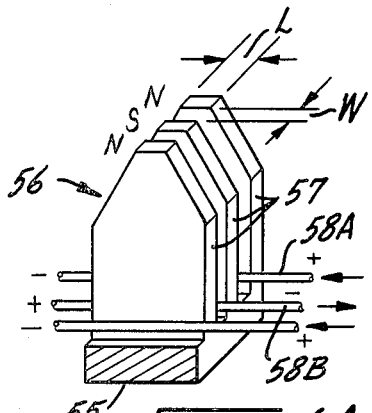
FIGS. 6A and 6B are enlarged detail views used to explain operation of the recording head in the printer of FIGS. 1-5.
Figure 6B:
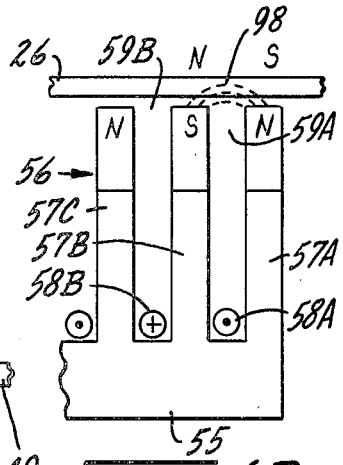

This magnetization operation can best be understood with reference to FIGS. 6A and 6B. When one of the conductors 58A is supplied with an electrical energizing current of the indicated polarity, magnetic flux is generated across the gap 59A between the two adjacent cores or pole pieces 57A and 57B, with the indicated magnetic polarity. A portion of the magnetic field across the two poles 57A and 57B extends upwardly through the thin permanent magnet platen 26 as indicated by flux lines 98 in FIG. 6B. Conductor 58A is energized for only a very brief interval, and with an amplitude sufficient to provide a magnetic field that is effective to magnetize a dot-size area of length L and width W in the upper surface of the platen. Dimensions L and W are determined primarily by the dimensions of the tips of cores 57. When conductor 58A is de-energized, the magnetized dot area at the upper surface of platen 26 has the polarity marked in FIG. 6B above the platen. An energizing current through conductor 58B has the same effect, using cores 57B and 57C and gap 59B, except that the polarity is reversed. Thus, core 57B is a part of two electromagnets, one including conductor 58A and core 57A, the other including conductor 58B and 57C. Core 57B is always a south pole, in either electromagnet; cores 57A and 57C are always north poles.

As previously noted, for successful operation of the embodiment of FIGS. 1–6, platen 26 should constitute an erasable permanent magnet material of high remanence and adequate coercive force. The Cunife and Chromindur alloys previously referred to are effective for this purpose, though other materials having similar characteristics may be employed. It is essential that platen 26 be quite thin in order that the magnetic field can penetrate the platen sufficiently to produce an effective magnetic image on the upper platen surface adjacent paper 87 to preclude undue spreading of the magnetic dot images.

By selective energization of the electromagnets of recording head 56, during movement of carriage 48 along platen 26 in the direction of arrow A, multiple dot size magnets are generated in the platen, constituting magnetic images of the data characters for a line of text. One such character 99 is shown in FIG. 3. Character 99 is shown in the seven-by-five matrix commonly employed in many impact printers; however, there can be a larger number of dots in each column, and a larger number of columns, particularly if improved print quality is desired.

Magnetic brush 68 moves into position over the magnetic images on platen 26 just after those magnetic images are formed; see FIGS. 1 and 3. The permanent magnet images attract toner particles 85 from the magnetic brush, so that a visible image of each character is developed on the upper surface of paper 87 generally concurrently with formation of the magnetic image of the character. The particular magnetic toner utilized for image development on the paper sheet is not critical. In this instance, it is assumed that the toner is one that can be fixed to the paper by application of adequate pressure. Toners of this pressure-fixing type are available commercially.

From the foregoing description, it will be apparent that a complete line of text, in the form of developed, visible characters, is formed in the course of conjoint movement of the two carriages 48 and 62 along platen 26 from left to right in the direction of arrow A. However, at this juncture, the toner is not affixed to the paper; if the paper were moved, the visible images could all be smeared into illegibility. That is, the adherence between the paper and the magnetic toner particles constituting the developed visible characters is insufficient to offset the attraction between the toner and the magnetic images in the platen; if a line space movement (arrow C, FIGS. 2 and 3), is effected, the data characters are distorted beyond recognition.

On the other hand, it has been found that there is some limited adherence between the paper and the toner particles constituting the developed visible character images, sufficient to permit movement of the paper without smearing of the characters if the magnetic images in platen 26 were not present. Of course, erasure of those magnetic images cannot be effected at this point without destroying the printed characters, because such erasure involves the use of magnetic fields tht would scatter the toner particles over the face of the paper. However, platen 26 can be moved away from paper 87 without disturbing the printed characters if it is moved in a direction transverse to the surface of the paper.

This is the reason for use of elevator mechanism 30. When a complete line of data characters, however long or short, has been printed on paper 87, though not yet fixed to the paper, motor 37 is actuated to rotate the two eccentrics 39 and displace elevator platform 31 and platen 26 downwardly, transversely to the surface of paper 87, to the position indicated by the phantom line 31A in FIGS. 1 and 2. The downward displacement of elevator platform 31 need not be large; a displacement of one centimeter is adequate to preclude substantial continuing magnetic attraction between the magnetic images in platen 26 and the developed visible data character images. Once platen 26 has been shifted downwardly away from paper 87 by operation of elevator mechanism 30, as described, paper 87 is advanced in the direction of arrow C (FIGS. 2 and 3) to bring the developed print characters into alignment with pressure fixing roller 96. Carriage 91 is then moved across paper 87, pressing the paper against support 24 and effectively fusing the dot matrix characters of the line of text into the upper surface of the paper. In order to assure adequate fixing pressure, the spring arms 92 and 93 of carriage 91 should be relatively stiff springs.

Carriage 91 may be returned to its original position prior to printing of the next line of text. On the other hand, printer 20 may be arranged to permit the pressure roller carriage 91 to remain at either side during formation of the data characters, moving back and forth across paper 87 in alternate directions for alternate lines of characters.

Of course, it is necessary to erase the magnetic images from platen 26 before the next line of characters is printed. Erasure of the platen in preparation for a new line of text is effected by moving carriage 48 back to its original position, in the direction of arrow B, with the erasing electromagnet comprising coil 61 and core 60 energized. In printer 20, coil 61 is energized with an alternating current during the carriage return movement to carry out the requisite erasure.

When the fixing and erasure steps have both been completed, motor 37 is energized to rotate in the opposite direction, raising elevator platform 31 back to its original position. In this manner, printer 20 is made ready for printing the next line of text. In some instances, one additional step may be necessary. Thus, if it is not possible to locate the pressure fixing position for roller 96 close enough to the printing position defined by recording head 56 so that these two positions are separated by only one line space increment, it may be necessary to provide a return movement of paper 87, opposite to arrow C, for proper positioning of the next line of print. Alternatively, the developed line may be left unfixed until it arrives at the fixing position.

From the foregoing description of printer 20, representing a first embodiment of the method and apparatus of the invention, it is seen that printing is effectively carried out on a character-by-character basis as required for typewriters, teleprinters, word processors, and other general office printers having low to moderate volume and speed requirements. The noise level is greatly reduced, as compared with any impact printer. Mechanical movements are limited to the once-per-line movements of carriages 48, 62 and 91 back and forth across the printer, the vertical movements of elevator 30, and the rotation of shell 79 of magnetic brush 68. As a consequence, a high level of reliability and a increased operating life, as compared with impact printers, can be anticipated. On the other hand, ordinary paper is used in the recording medium, so that no cost increase is incurred in this area. The pressure fixing position, defined by the path of roller 96 (see FIG. 3), is completely displaced from the thin platen 26; the appreciable pressures developed during fixing cannot adversely affect the platen.

As printer 20 forms each data character, the continuing movement of the second carriage 62 rapidly reveals the last character formed; viewing is easily effected as indicated by arrow V in FIG. 2. If carriages 48 and 62 stop in the middle of platen 26, immediately after completion of a character, that character may be blocked from view by carriage 62 and magnetic brush housing 69. It is a simple matter, however, to provide effective LCV operation even in this circumstance by continuing the advance of carriage 62 a short, measured distance in the direction of arrow A when printing is interrupted, clearing the way for viewing of the last character. Carriage 62 can then be returned through the same distance, in the direction of arrow B, if continued printing of additional text on the same line is required.

FIG. 7 provides a view generally comparable to FIG. 2 but illustrates a printer 120 comprising another embodiment of the present invention and capable of carrying out a modification of the method of the invention. Printer 120 includes a thin, elongated strip platen 126 upon which a sheet of ordinary non-magnetic paper 187 is positioned. A first carriage 148 is included in printer 120, positioned below platen 126; carriage 148 is movable along the length of the platen as in the previously described embodiment. In this instance, however, the first carriage is mounted on two fixed guide rails 146; printer 120 does not include an elevator like mechanism 30 of FIGS. 1 and 2. A drive belt 149 is shown connected to carriage 148.

A recording head 156 is mounted on carriage 148. This recording head 156 comprises a plurality of electromagnets each including a core 157 and a coil 158 (see FIGS. 7 and 8). The electromagnet cores 157 are of generally linear configuration, each having a single small pole face 159 facing upwardly toward the bottom surface of platen 126. Carriage 148 also supports an erase magnet (not shown) having a configuration like erase magnet core 60 (FIGS. 1 and 2); in this case the erase magnet may be a permanent magnet, with polarity opposite that used for the recording electromagnets. An electromagnet can also be used for erasure.

Printer 120 includes a second carriage 162 that, as before, moves conjointly with the first carriage 148. A magnetic brush 168 within a housing 169 is mounted on carriage 162. In this instance, the magnetic brush may be aligned directly over recording head 156. As before, carriage 162 is mounted on two guide rails 163 and is driven by a drive belt 164.

FIG. 8 illustrates the manner in which one of the electromagnets 157,158 magnetizes an incremental area of platen 126. Thus, whenever coil 158 is supplied with an electrical energizing current of the indicated polarity, core 157 develops a north magnetic pole at its pole face 159 immediately adjacent the bottom surface of platen 126. In this instance, the platen is formed of a ferrite material having a high coercive force and low permeability. Energization of the recording electromagnet 157,158 produces a permanently magnetized dot size area in the platen. The dimensions of the dot are determined by the dimensions of pole face 159 and by the intensity of the magnetic field. The size of the magnetized dot image, as seen from the top surface of platen 126, may tend to increase over the size of the pole face 159 with increased platen thickness. To minimize this "spreading" tendency, the thickness of platen 126 should be held to a minimum. Typically, platen 126 has a thickness of the order of 0.25 millimeters.

In printer 120, FIG. 7, pressure fixing of the data characters is again employed. In this instance, the fixing apparatus comprises two elongated power driven pressure rollers 196 and 197 mounted extending across the full width of paper sheet 187 parallel to the lines of data characters imprinted upon the paper. As will be readily apparent, rollers 196 and 197 can provide a dual function; thus, these rollers can be utilized to advance paper 187 in the line feed direction, arrow C, in addition to pressure fixing the developed toner images to the paper.

In printer 120, platen 126 is again mounted in a rectangular frame 127. One side rail of this frame is mounted upon a paper support 123 by means of an elongated piano hinge 131. A series of individual hinges may be used if desired.

Operation of a printer incorporating the modifications indicated by mechanism 120 of FIG. 7, for magnetic recording and development of a line of data characters on paper sheet 187, proceeds in much the same manner as described for the embodiment of FIGS. 1-6. When the line of data text is complete and developed, and prior to fixing of the developed toner character images on paper sheet 187, the rectangular frame supporting platen 126 is pivoted, by means of hinge 131, to the phantom line position 126A. This can be accomplished without disturbing the undeveloped printing on paper sheet 187 because the movement of the platen is again in a direction generally transverse to the surface of the paper, in contrast with a lateral movement of the platen which would smear the print. As before, there is enough adherence between the unfixed developed toner images and the paper sheet so that the paper can now be shifted in a line feed direction (arrow C), passing between pressure roller 196 and 197.

In printer 120, because the magnetic brush toner dispenser 168 is located directly over the recording electromagnets, printing can be carried out for movement of the print head carriage 162 along strip platen 126 in either direction if two erasing electromagnets, one for each direction, are provided on carriage 148. In printing mechanism 120, as in printer 20, pressure fixing is made possible without the danger of undue stress on the thin, fragile permanent magnet platen.

FIG. 9 illustrates a printer 220 comprising a further embodiment of the invention; the modification pertains to the fixing station of the printer. Thus, printer 220 includes a lower carriage 248 riding on fixed guide rails 246 and driven by a belt 249, a magnetic recording head 256 being mounted on this carriage. Recording head 256 may utilize the same construction as head 56 (FIGS. 1–3, 6A and 6B), magnetizing platen 126 in the parallel mode; head 256 may equally well employ the construction of head 156 (FIGS. 7 and 8) for perpendicular mode magnetization of the platen. The movable platen construction illustrated in FIG. 9 corresponds to that of FIG. 7, including a thin ferrite strip platen 226 mounted in a rectangular frame 227 that is hinged to a paper support 223 by an elongated hinge 231. A toner dispenser 269 is mounted on an upper carriage 262 that slides along two guide rails 263, with the driving force supplied by a belt 264.

In printer 220, after the visible toner images are developed on the upper surface of a paper sheet 287 positioned on platen 226, the platen is pivoted downwardly to an alternate position 226A. Paper sheet 287 is then advanced in the direction of arrow C to a fixing position on a support 224, with the unfixed line of print located beneath a heat source 296. In this instance, a heat-fusible magnetic toner is used for printing. In all other respects, the operation of printer 220 is essentially as described in connection with the previous embodiments.

It will be recognized that a variety of different combinations of the various features of printers 20, 120, and 220 can be effected; there is little point in attempting to illustrate all such variations. For example, the various forms of pressure fixing shown in printers 20 and 120, can be employed in conjunction with either parallel mode magnetic recording as exemplified by recording head 56 (FIGS. 1–3 and 6) or perpendicular mode magnetic recording as effected by recording head 156 (FIGS. 7 and 8). Conversely, a printer that records magnetically in either the parallel mode or the perpendicular mode can employ a heat-fixable toner, with a heater (FIG. 9) to carry out the image fixing step. Moreover, bidirectional imaging and developing can be carried out with either pressure fixing or heat fixing of the toner. A printer need not be restricted solely to unidirectional or bidirectional imaging and developing; thus, a given printer could be controlled for unidirectional printing when used in a typewriter, a telex transceiver, or in any other manual data entry application, with a changeover to control for bidirectional printing when used as a receiver.

For all embodiments, printing is a quiet operation as compared to any impact printer. Printing speeds are adequate for all low to moderate volume applications, covering the full range of general office printer requirements. LCV capability is readily realized for all embodiments. Cost and reliability characteristics should be excellent. In all embodiments, fixing is dissociated from magnetic recording and developing, eliminating any possible damage to the thin strip platens that might otherwise be encountered.

I claim:

1. In a method of magnetic dot matrix printing, for printing a character text on a sheet of non-magnetic paper, comprising the following steps in sequence:

A. positioning a sheet of non-magnetic paper on a platen of permanent magnet material with the platen in a predetermined print position;

B. magnetizing dot size portions of the platen in accordance with predetermined patterns constituting magnetic images of the data characters for a line of text; and C. developing visible images of the characters on the paper by applying limited quantities of a magnetic toner to the exposed surface of the paper overlying the platen;

the improvement comprising the following additional steps:

D. displacing the platen from its print position, away from the paper, in a direction generally transverse to the surface of the paper, through a distance sufficient to preclude substantial magnetic attraction between the magnetic images and the toner comprising the developed visible images;

E. advancing the paper, in a direction substantially parallel to the paper surface, by at least one line space, to move the visible toner images to a fixing position clear of the printing position of the platen after step D; and F. fixing the visible toner images on the paper at the fixing position.

2. The method of dot matrix printing, according to claim 1, comprising the following additional steps:

G. restoring the platen to its print position after step E;

H. erasing the magnetic images from the platen; and

I. repeating steps B through F to print a subsequent line of text on the paper.

3. The method of dot matrix printing, according to claim 1 or claim 2, in which printing is effected on a character-by-character basis, and in which:

step B is carried out by moving a magnetic recording head, comprising a plurality of electromagnets having magnetizing poles corresponding to a group of character matrix dots, longitudinally along a path in closely spaced spaced relation to one platen surface, and selectively energizing the electromagnets for limited intervals during that movement; and step C is carried out by moving a toner dispenser along the path of the recording head in synchronism with the recording head and in an alignment relative to the recording head such that development of the visible images occurs generally concurrently with formation of the magnetic images in step B.

4. The method of character-by-character magnetic dot matrix printing, according to claim 3, in which the toner dispenser is moved along the path a short distance behind the recording head so that development of the visible images occurs immediately after the formation of the magnetic images in step B.

5. The method of character-by-character magnetic dot matrix printing, according to claim 3, in which the toner dispenser and recording head are located on opposite sides of the platen and the toner dispenser is aligned directly opposite the recording head so that development of the visible images occurs essentially simultaneously with the formation of the magnetic images in step B.

6. The method of dot matrix printing, according to claim 1, in which step F is carried out by moving a pressure roller across the surface of the paper bearing the visible toner images, along the line of text, the pressure roller pressing the paper against a support engaging its opposite surface and thereby pressure-fixing the visible toner images on the paper.

7. The method of dot matrix printing, according to claim 6, in which the support is a fixed, flat support.

8. The method of dot matrix printing, according to claim 1, in which step F is carried out concurrently with step E by advancing the paper between a pair of power driven pressure rollers, extending parallel to the line of text, the paper advance of step E being effected by rotation of the two pressure rollers.

9. The method of dot matrix printing, according to claim 1, in which step F is carried out by heating of the visible toner images.

10. The method of dot matrix printing according to claim 6, or claim 7, or claim 8, or claim 9, in which printing is effected on a character-by-character basis, and in which:

step B is carried out by moving a magnetic recording head, comprising a plurality of electromagnets having magnetizing poles corresponding to a group of character matrix dots, longitudinally along a path in closely spaced spaced relation to one platen surface, and selectively energizing the electromagnets for limited intervals during that movement; and step C is carried out by moving a toner dispenser along the path of the recording head in synchronism with the recording head and in an alignment relative to the recording head such that development of the visible images occurs generally concurrently with formation of the magnetic images in step B.

11. The method of character-by-character magnetic dot matrix printing, according to claim 10, in which the toner dispenser is moved along the path a short distance behind the recording head so that development of the visibile images occurs immediately after the formation of the magnetic images in step B.

12. The method of character-by-character dot matrix printing, according to claim 10, in which the toner dispenser and recording head are located on opposite sides of the platen and the toner dispenser is aligned directly opposite the recording head so that development of the visible images occurs essentially simultaneously with the formation of the magnetic images in step B.

13. In a magnetic dot matrix printer for printing a character text on a sheet of non-magnetic paper, of the kind comprising:

an elongaged strip platen of permanent magnet material;

means for positioning a sheet of non-magnetic paper on one surface of the platen with the platen extending across the paper in alignment with a portion of the paper comprising a location for a line of text;

magnetic recording means, comprising a plurality of electromagnets having magnetizing poles corresponding to a group of character matrix dots, for magnetizing dot size portions of the platen in accordance with predetermined patterns constituting magnetic images of the characters for a line of text by selective energization of the electromagnets;

magnetic toner dispensing means for applying limited quantities of a magnetic toner to the exposed surface of the paper overlying the platen to develop visible images, corresponding to the magnetic images, on the paper; and magnetic erasing means for erasing the magnetic images from the platen in preparation for printing a further line of text;

the improvement comprising:

platen displacement means for displacing the platen, in a direction generally transverse to the paper surface, between a print position engaging the paper and an inactive position, the displacement between the two platen positions being sufficient to preclude substantial magnetic attraction between the magnetic images and the visible toner images when the platen is in its inactive position;

line feed means for advancing the paper, in a direction substantially parallel to the paper surface, to move the visible toner images to a fixing position displaced from the platen print position; and fixing means for fixing the visible toner images on the paper, while at the fixing position, to complete printing of a line of text on the paper.

14. A magnetic dot matrix printer, according to claim 13, in which the fixing means comprises a heater means for heating the visible toner images at the fixing position.

15. A magnetic dot matrix printer, according to claim 13, in which the fixing means comprises a pressure roller for pressing the visible toner images into the paper.

16. A magnetic dot matrix printer, according to claim 15, in which the pressure roller is oriented with its axis of rotation transverse to the line of text, and in which the fixing means further comprises:

a fixed support, at the fixing position supporting the surface of the paper opposite the visible toner images; and means for moving the pressure roller along the line of text, at the fixing position, pressing the paper against the fixed support.

17. A magnetic dot matrix printer, according to claim 15, in which the pressure roller extends across the paper, at the fixing position, for at least the full maximum length of the line of text, and in which the fixing means further comprises a second pressure roller parallel to and aligned with the aforesaid pressure roller.

18. A magnetic dot matrix printer, according to claim 17, and further comprising drive means for rotating the pressure rollers to advance the paper therebetween, so that the pressure rollers are common to the fixing means and the line feed means.

19. A magnetic dot matrix printer, according to claim 13, or claim 14, or claim 15, or claim 16, or claim 17, in which printing is effected on a character-by-character basis, and further comprising:

carriage means reciprocally movable along a path adjacent the platen, from one end of the text line location to the other and back again;

the magnetic recording means, the toner dispensing means, and the erasing means all being mounted on the carriage means;

the relative positions of the toner dispensing means and magnetic recording means on the carriage means being such that development of the visible toner images occurs generally concurrently with formation of the magnetic images.

20. A magnetic dot matrix printer, according to claim 13, or claim 14, or claim 15, or claim 16, or claim 17, in which the platen displacement means comprises a linearly movable elevator, on which the platen is mounted, and elevator drive means for moving the elevator between a print position and an inactive position.

21. A magnetic dot matrix printer, according to claim 20, in which the elevator drive means comprises an eccentric drive connection actuated by a rotary motor.

22. A magnetic dot matrix printer, according to claim 13, or claim 14, or claim 15, or claim 16, or claim 17, in which the platen is hinged to a fixed support, along one longitudinal edge of the platen, and in which the platen displacement means shifts the platen pivotally between its print position and its inactive position.

* * * * *